US007674208B2

(12) United States Patent
Hoole

(10) Patent No.: US 7,674,208 B2
(45) **Date of Patent: *Mar. 9, 2010**

(54) APPARATUS AND METHOD FOR CHANGING BARBELL WEIGHTS

(76) Inventor: Richard J. Hoole, 102 Cunningham Dr., New Smyrna Beach, FL (US) 32168

( * ) Notice: Subject to any disclaimer, the term of this patent is extended or adjusted under 35 U.S.C. 154(b) by 45 days.

This patent is subject to a terminal disclaimer.

(21) Appl. No.: 11/881,649

(22) Filed: Jul. 27, 2007

(65) Prior Publication Data

US 2008/0248931 A1 Oct. 9, 2008

Related U.S. Application Data

(63) Continuation-in-part of application No. 11/784,351, filed on Apr. 6, 2007.

(51) Int. Cl.
*A63B 21/078* (2006.01)

(52) U.S. Cl. ..... 482/104

(58) Field of Classification Search ..... 482/104; D21/686; 211/19, 20, 23, 24, 40, 41.12, 211/85.7; 248/346.01, 346.03, 671
See application file for complete search history.

(56) References Cited

U.S. PATENT DOCUMENTS

| | | | | |
|---|---|---|---|---|
| 2,971,769 | A * | 2/1961 | Gaddis | 280/79.11 |
| 3,542,157 | A * | 11/1970 | Noah | 188/32 |
| 4,529,198 | A | 7/1985 | Hettick, Jr. | |
| 4,773,642 | A * | 9/1988 | Cruz | 482/104 |
| 4,971,318 | A | 11/1990 | Tracy | |
| 5,772,561 | A | 6/1998 | Hayden | |
| 5,954,619 | A * | 9/1999 | Petrone | 482/104 |
| 6,039,678 | A | 3/2000 | Dawson | |
| 6,123,651 | A | 9/2000 | Ellenburg | |
| 6,758,346 | B2 * | 7/2004 | Kollegian | 211/40 |
| 6,758,795 | B2 | 7/2004 | Barber | |
| D495,383 | S * | 8/2004 | Ceppo | D21/686 |
| D528,612 | S * | 9/2006 | Black | D21/686 |
| 7,285,077 | B1 * | 10/2007 | Marx | 482/104 |
| 2004/0162197 | A1 | 8/2004 | Towley, III et al. | |
| 2006/0116255 | A1 | 6/2006 | Scrivens | |
| 2006/0205573 | A1 | 9/2006 | Savage | |

* cited by examiner

*Primary Examiner*—Loan H Thanh
*Assistant Examiner*—Allana Lewin
(74) *Attorney, Agent, or Firm*—Paul S. Rooy P.A.

(57) ABSTRACT

An apparatus and method for changing barbell weights. The apparatus includes at least one stand having a ramp sloping upwards to a first cradle and a second cradle. The first cradle is sized to hold a circular barbell weight. The height of the first cradle exceeds the height of the second cradle by at least the difference between a weight bore diameter and a bar diameter. When a barbell is supported in the stand, only an innermost weight at each barbell end rests against the cradle floor; the other weights all depend from the bar and are easily slid off of, and onto, the bar. Method steps include rolling the barbell onto one or more stands, changing weights as desired, and rolling the barbell off of the stand(s).

28 Claims, 8 Drawing Sheets

APPARATUS AND METHOD FOR CHANGING BARBELL WEIGHTS

CLAIM FOR PRIORITY

This application based on, and is a continuation-in-part, of U.S. patent application Ser. No. 11/784,351 filed Apr. 6, 2007, and claims the benefit of the earlier filing date of that application.

BACKGROUND OF THE INVENTION

1. Field of the Invention

This invention relates to barbells, and in particular to an apparatus and method for changing barbell weights.

2. Background of the Invention

Weightlifting is a popular and effective way to strengthen muscles. Barbells are used frequently in this type of exercise. As may be observed in FIGS. 7-12, a typical barbell 40 comprises a bar 42 upon which weights 44 are slid. A collar 46 serves to prevent weights 44 from sliding off bar 42.

A plurality of weights 44 may be slid onto bar 42, depending on how much total weight is to be employed in the particular exercise being conducted. Thus, the ability of quickly and easily changing weights 44 is advantageous in setting up a barbell 40 for exercise.

However, where barbell 40 rests on the ground, friction between weights 44 and the ground makes removal and installation of weights 44 on bar 42 difficult. Typically, an individual must lift up an end of bar 44 with one hand, and slide weights 44 on or off with the other hand. This can be rather difficult for smaller individuals or children due to the physical strength required to perform this maneuver. Thus, it would be desirable to provide an apparatus and method for changing barbell weights which permits the quick and easy removal and installation of weights on a bar.

Existing Designs

A number of approaches have been proposed to achieve this objective. U.S. Pats. No. 6,758,795, 6,039,678, 4,971,318, 4,531,728 and 4,529,198 were granted Barber, Dawson, Tracy, Wright and Hettick, Jr. respectively for apparatuses which permitted weights to be added and removed from bars. The application of Towley, III published as US 2004/0162197, was directed towards the same purpose. Notably, Barber '795 taught a bar incorporating bellows-like containers at each end which could be filled with varying amounts of water to achieve the weight desired. These apparatuses suffered from the drawback that non-standard weights were required to be used with the inventions they taught. Thus, standard, existing weights could not be used according to these patents.

U.S. Pats. No. 6,123,651 and 5,772,561 were awarded Ellenburg and Hayden respectively, and U.S. patent applications, published as 2006/0205573 and 2006/0116255 by Savage and Scrivens respectively, taught barbell and dumbbell stands. While these stands appeared capable of supporting barbells and/or dumbbells, no provision for quickly and easily changing weights was disclosed.

SUMMARY OF THE INVENTION

Accordingly, it is an object of the present invention to provide an apparatus and method for changing barbell weights which permits weights to be quickly and easily removed and installed on a bar. Design features allowing this object to be accomplished include a stand incorporating a ramp leading up to a cradle, which a barbell can be rolled onto. Advantages associated with the accomplishment of this object include the ability to change barbell weights without having to physically lift up one end of the barbell, with the attendant increase in convenience and speed of changing out weights, and reduction in the chances of incurring injury while doing so.

It is another object of the present invention to provide an apparatus and method for changing barbell weights which can be used with existing barbells. Design features allowing this object to be accomplished include a ramp leading up to a cradle, which an existing barbell can be easily rolled onto. Benefits associated with the accomplishment of this object include obviation of the necessity of having to purchase new weight equipment, with the attendant increased convenience and cost savings.

It is still another object of this invention to provide a method for changing barbell weights. Design steps enabling the accomplishment of this object include rolling a barbell up a ramp and into a first cradle, such that an innermost weight of barbell resides on the first cradle floor; removing or adding weights from the barbell as desired; and rolling the barbell out of the first cradle, down the ramp, and off the stand. Advantages associated with the realization of this object include the ability to quickly and easily add and remove weights from an existing barbell without having to manually lift the barbell, and the attendant increased convenience and decreased risk of injury.

It is yet another object of this invention to provide a apparatus for changing barbell weights which is inexpensive to manufacture. Design features allowing this object to be achieved include the use of components made of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIG. 1. Sheet two contains FIG. 2. Sheet three contains FIGS. 3 and 4. Sheet four contains FIGS. 5 and 6. Sheet five contains FIGS. 7 and 8. Sheet six contains FIGS. 9 and 10. Sheet seven contains FIGS. 11 and 12. Sheet eight contains FIG. 13.

DETAILED DESCRIPTION OF THE PREFERRED EMBODIMENT

Figure 1:
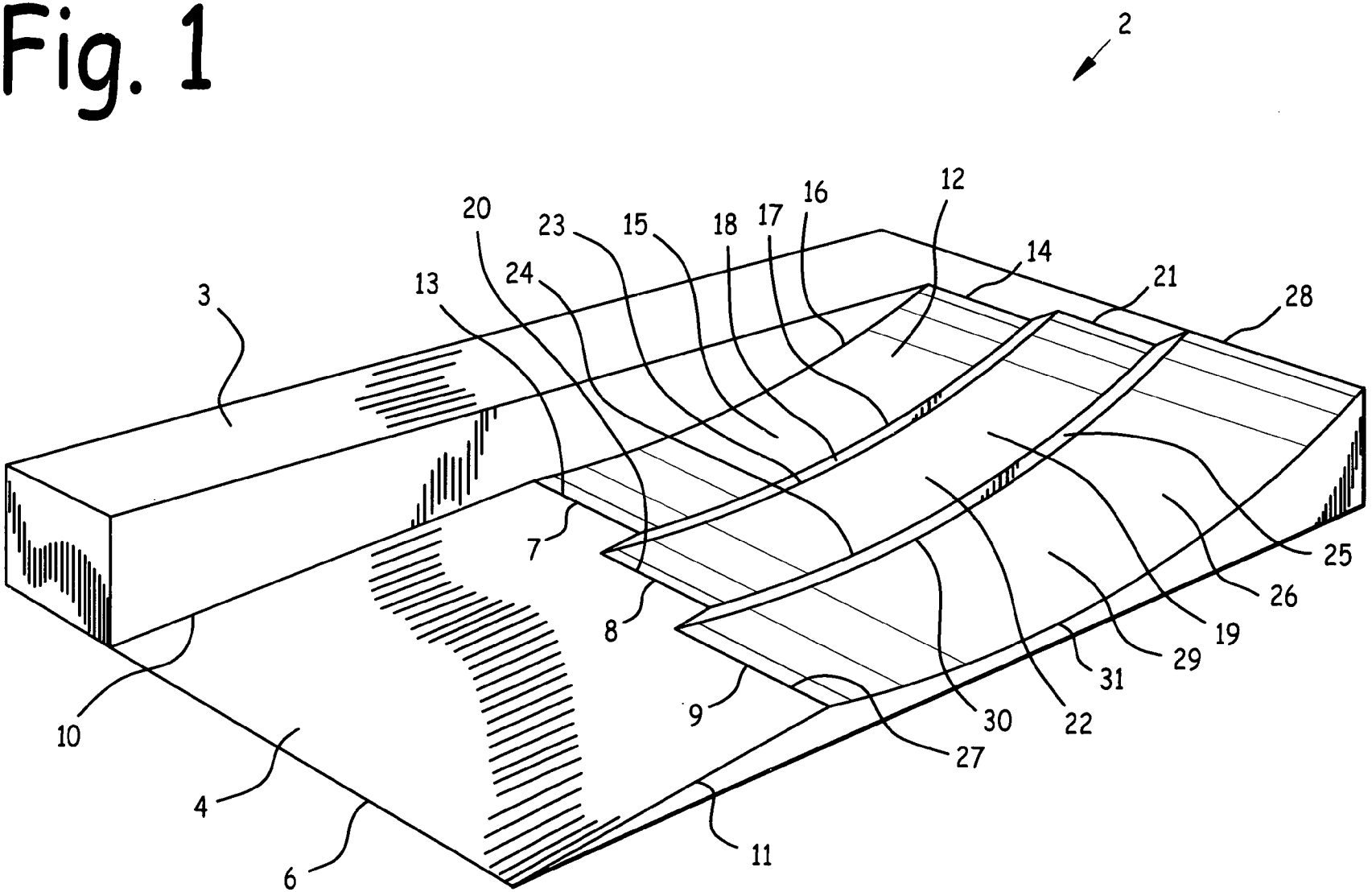
FIG. 1 is a right quarter side elevated isometric view of a stand.
Figure 2:
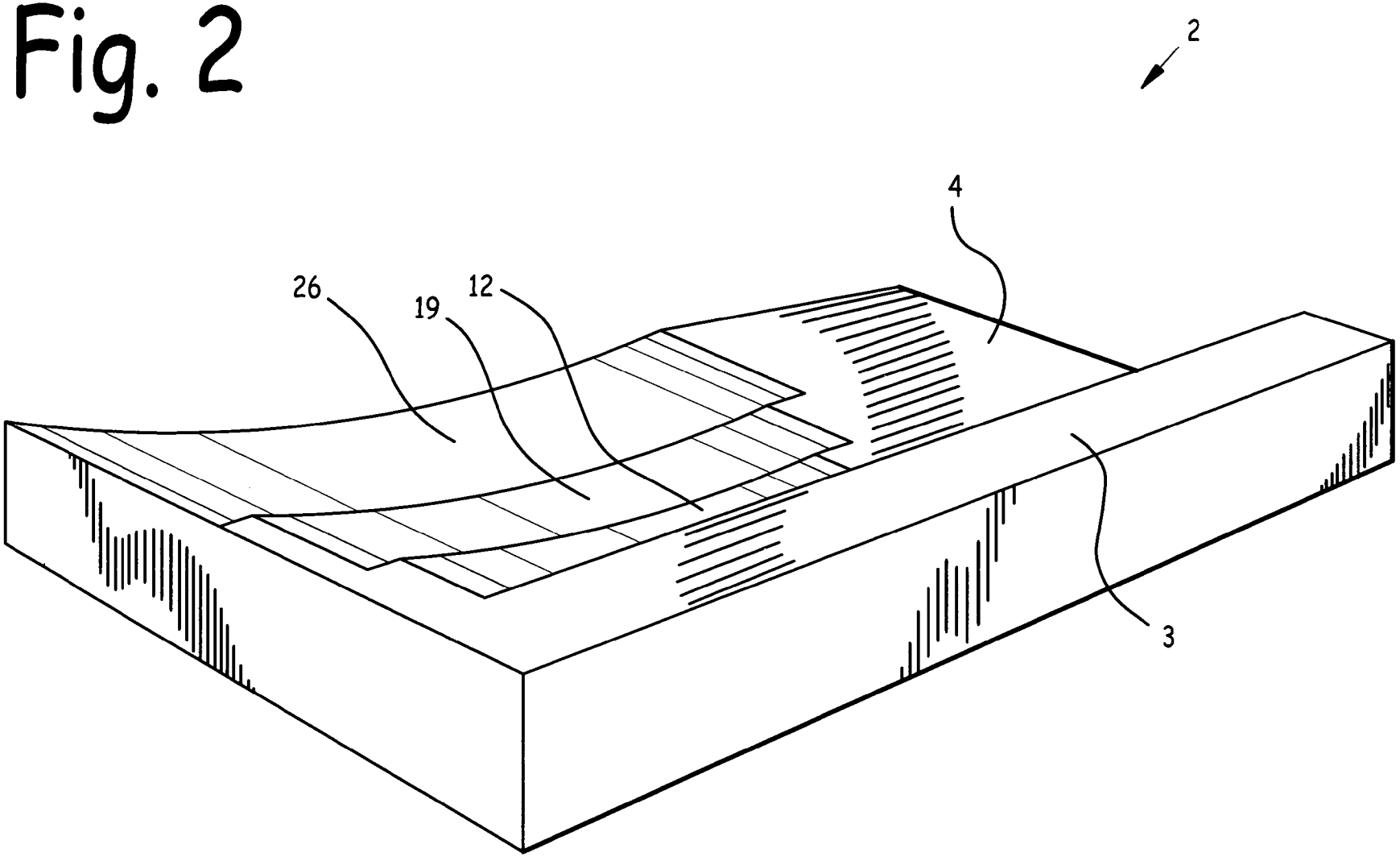
FIG. 2 is a left quarter elevated isometric side view of a stand.
Figure 3:
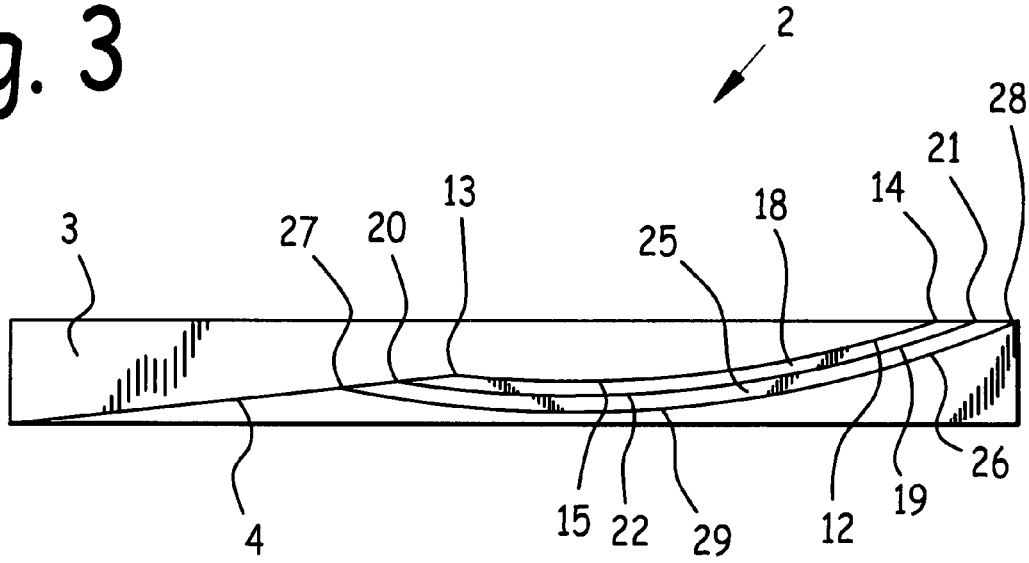
FIG. 3 is a right side view of a stand.
Figure 4:
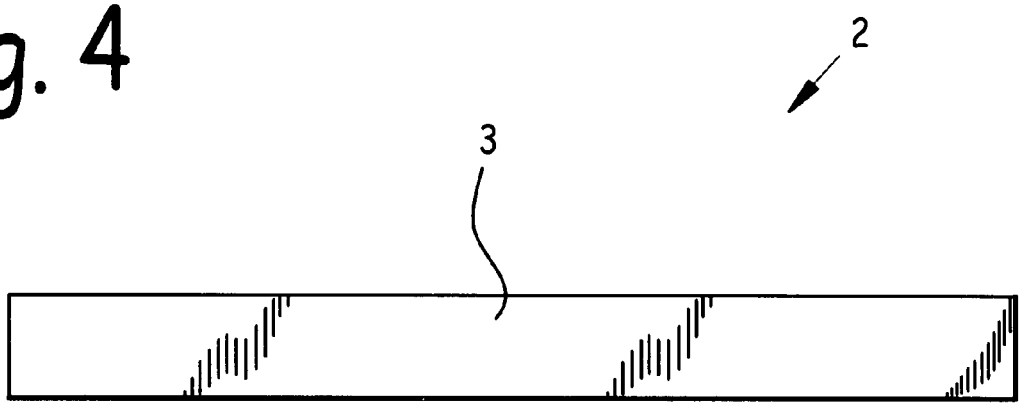
FIG. 4 is left side view of a stand.
Figure 5:
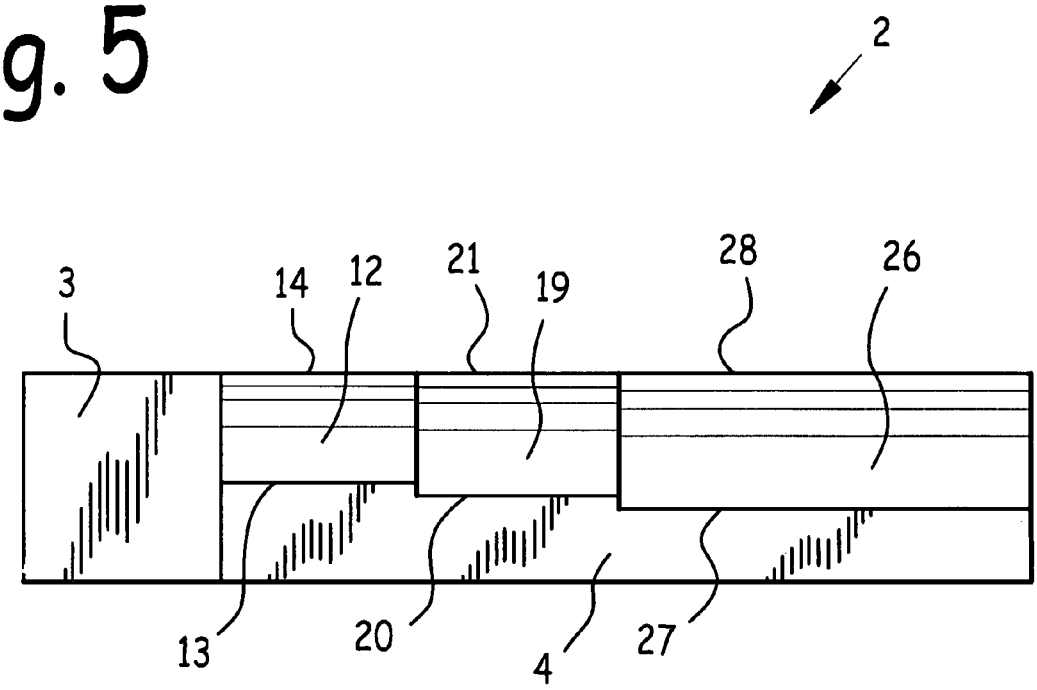
FIG. 5 is a rear view of a stand.
Figure 6:
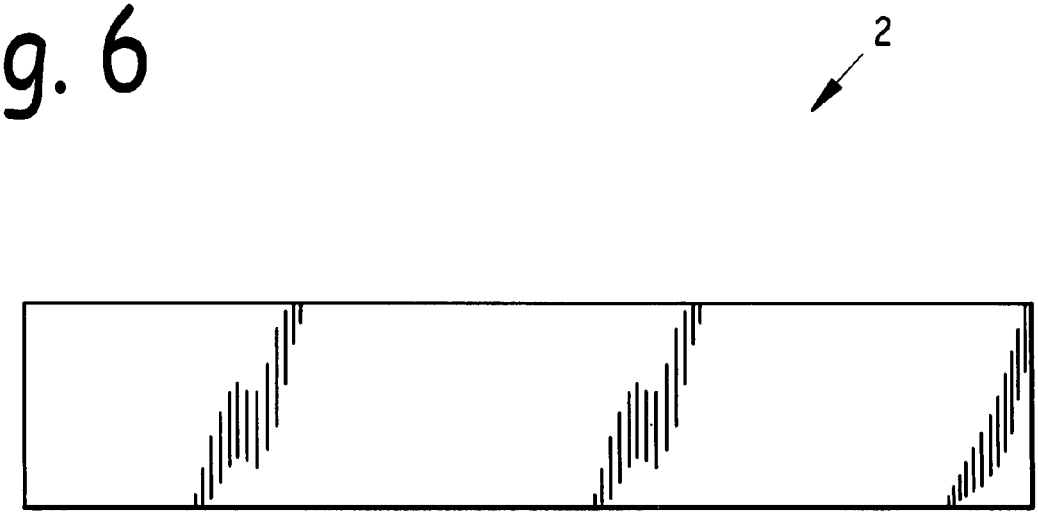
FIG. 6 is a front view of a stand.

FIG. 1 is a side quarter elevated isometric view of stand 2. FIG. 2 is a left quarter elevated isometric side view of stand 2. FIG. 3 is a right side view of stand 2. FIG. 4 is left side view of stand 2. FIG. 5 is a rear view of stand 2. FIG. 6 is a front view of stand 2. Referring now to these figures, stand 2 comprises ramp 4 sloping up to first cradle 12, second cradle 19 and third cradle 16. Railing 3 is disposed adjacent first cradle 12 along an edge of stand 12 opposite third cradle 26. Because the height of railing 3 exceeds that of first cradle 12, railing 3 serves as a sidewall to prevent a weight disposed in stand 2 from sliding out of first cradle 12.

Each cradle comprises a cradle floor bounded by a cradle proximal lip, cradle distal lip, cradle inner edge, and cradle outer edge. Each cradle slopes gently downwards from its proximal lip towards its lowest area between its proximal lip and its distal lip, and then slopes gently upwards to its distal lip.

Thus, first cradle 12 comprises first cradle floor 15 bounded by first cradle proximal lip 13, first cradle distal lip 14, first cradle inner edge 16, and first cradle outer edge 17. Second cradle 19 comprises second cradle floor 22 bounded by second cradle proximal lip 20, second cradle distal lip 21, second cradle inner edge 23, and second cradle outer edge 24. Third cradle 26 comprises third cradle floor 29 bounded by third cradle proximal lip 27, third cradle distal lip 28, third cradle inner edge 30, and third cradle outer edge 31.

First cradle floor 15 is higher than second cradle floor 22 by a height equal to the height of first cradle wall 18, Second cradle floor 22 is higher than third cradle floor 29 by a height equal to the height of second cradle wall 25, which extends upwards vertically from third cradle inner edge to second cradle outer edge 24.

Ramp 4 is bounded by ramp proximal edge 6, ramp inner edge 10, ramp outer edge 11, and ramp first distal edge 7 disposed adjacent first cradle 12, ramp second distal edge 8 disposed adjacent second cradle 19, and ramp third distal edge 9 disposed adjacent third cradle 26. Ramp 4 slopes upwards from ramp proximal edge 6 to ramp distal edges 7, 8 and 9.

As may be observed in FIG. 3, a right side view of stand 20, the cradle proximal lip and cradle distal lip pertaining to each cradle are higher than the corresponding cradle floor they bound: the height of first cradle proximal lip 13 and first cradle distal lip 14 exceeds the height of first cradle floor 15; the height of second cradle proximal lip 20 and second cradle distal lip 21 exceeds the height of second cradle floor 22; and the height of third cradle proximal lip 27 and third cradle distal lip 28 exceeds the height of third cradle floor 29.

Thus, a barbell rolled up ramp 4 and into first cradle 12 will be constrained on first cradle floor 15 by first cradle proximal lip 13 and first cradle distal lip 14. As may be observed in FIG. 10, because the height of first cradle floor 15 exceeds the height of second cradle floor 22, a barbell 40 which has been rolled into first cradle 12 is supported solely by its innermost weight 44.

Because barbell 40 is supported solely by its innermost weight 44, any weights other than the inner-most weight 44 may be quickly and easily slid off or onto bar 42, because there is no frictional interference between second cradle floor 22 and the weights 44 being slid off or onto bar 42. Similarly, because the height of third cradle floor 29 is less than the height of second cradle floor 22, any weights other than the inner-most weight 44 may be quickly and easily slid off or onto bar 42, because there is no frictional interference between third cradle floor 29 and the weights 44 being slid off or onto bar 42.

Figure 7:
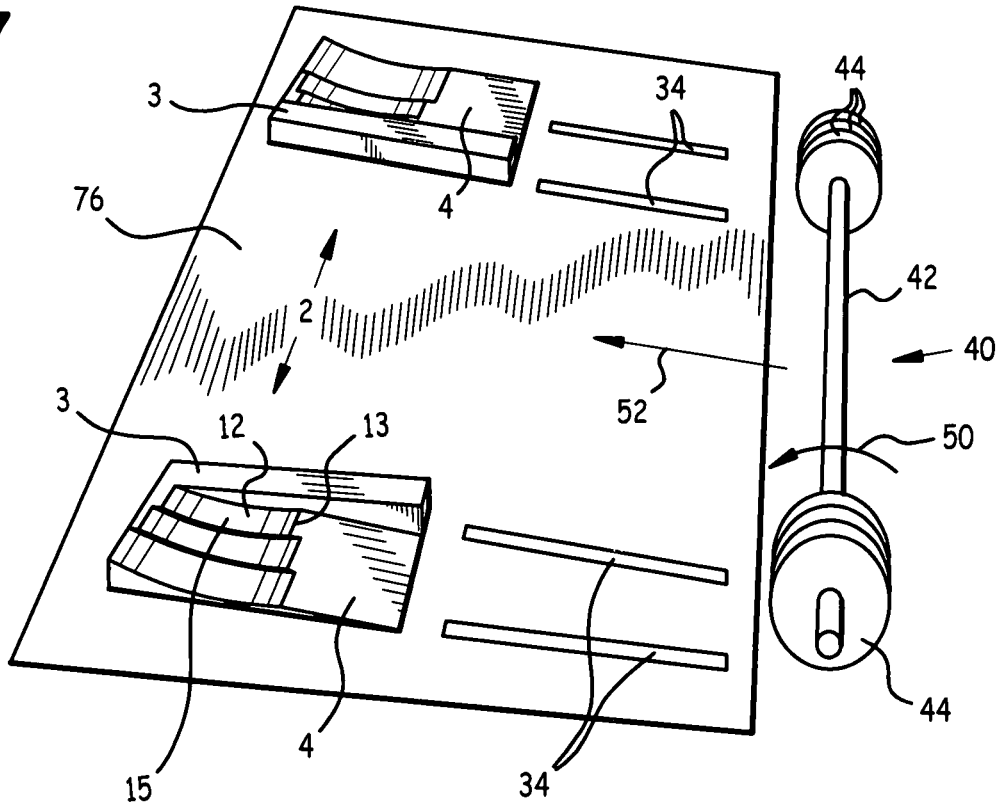
FIG. 7 is an elevated isometric view of a barbell about to be rolled onto a pair of stands.
Figure 8:
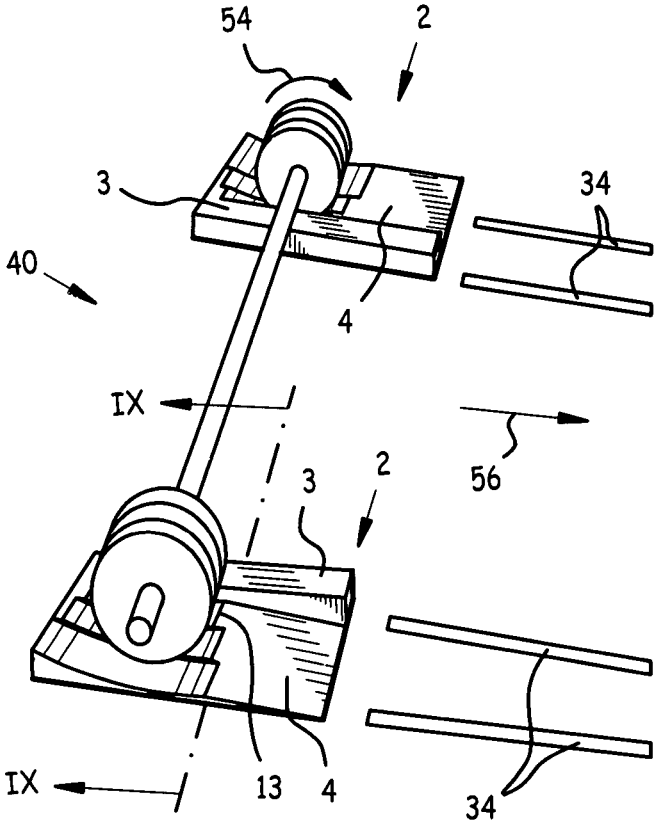
FIG. 8 is an elevated isometric view of a barbell which has been rolled onto a pair of stands.

Railing 3 may be installed along ramp inner edge 10 and first cradle inner edge 16 to help constrain barbell 40 in the correct location atop stand 2, not only when rolling onto and off of stand 2 as depicted in FIGS. 7 and 8, but also when stationary on stand 2 as depicted in FIGS. 8-12.

FIG. 7 is an isometric view of barbell 40 about to be rolled onto a pair of stands 2. Barbell 40 rolls on circular weights 44 on bar 42. When used as a pair, one stand 2 is a mirror image of the other stand 2, so that the railing 3 side of the stands 2 can face each other. When barbell 40 has been rolled onto the pair of stands 2, its weight stacks at either end of bar 42 straddle the two railings 3, thereby preventing barbell 40 from sliding laterally out of place.

FIG. 8 is an isometric view of barbell 40 which has been rolled onto a pair of stands 2. A major advantage of the instant invention is the ability to roll barbell 40 up the gentle slope of ramp 4, over first cradle proximal lip 13, and into first cradle 12, as indicated by arrows 50 and 52 in FIG. 7. The ease of rolling an existing barbell 40 onto and out of stand 2 is important, because even a small person or child can easily do so in order to change weights 44 on bar 42, and the instant apparatus is useable with existing barbells 40.

Rolling barbell 40 out of stand 2 is just as easy, because first cradle proximal lip 13 is a minor ridge, and the slope from first cradle floor 15 to first cradle proximal lip 13 gentle, so that relatively little force is required to roll barbell 40 out of first cradle 12 and over first cradle proximal lip 13 as indicated by arrows 54 and 56 in FIG. 8. Once barbell 40 has been rolled out of first cradle 12 and onto ramp 4, gravity assists barbell 40 in rolling down ramp 4 and off stand 2.

While FIGS. 7 and 8 depict a pair of stands 2 in use, a single stand 2 could also be used in order to change weights 44 on a single end of bar 42. Thus, a single stand 2 could be used to change weights on a single end of bar 42, or sequentially to change weights 44 on opposite ends of bar 42 by first rolling the stack of weights 44 on one end of bar 42 onto the stand 2, changing weights 44 as desired, rolling that stack of weights off stand 2, and then repeating these steps for the stack of weights 44 on the opposite end of bar 42.

Figure 9:
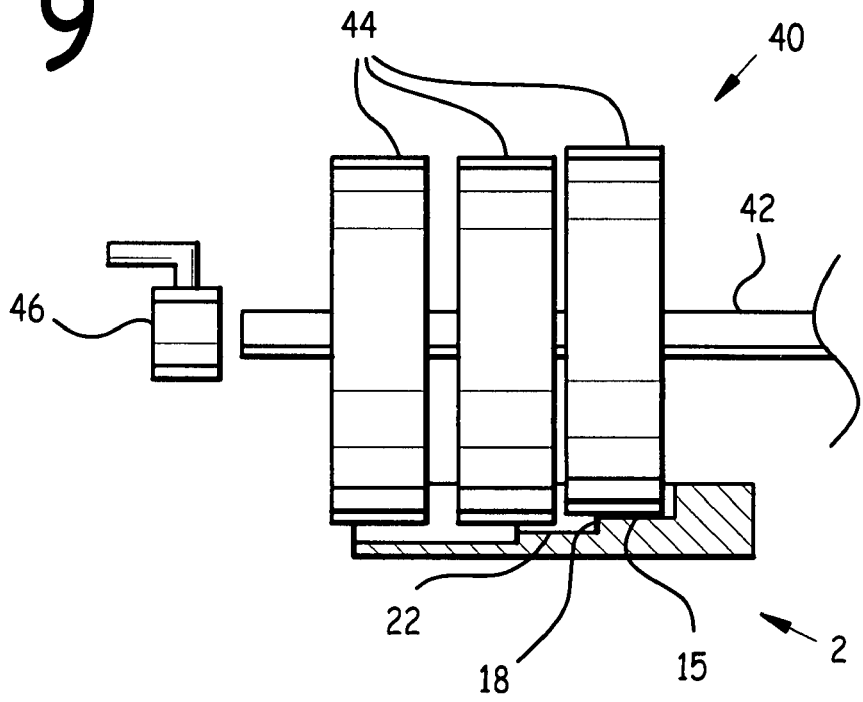
FIG. 9 is a rear cross-sectional view of a barbell having a plurality of weights resting on a stand taken at section IX-IX of FIG. 8.
Figure 10:
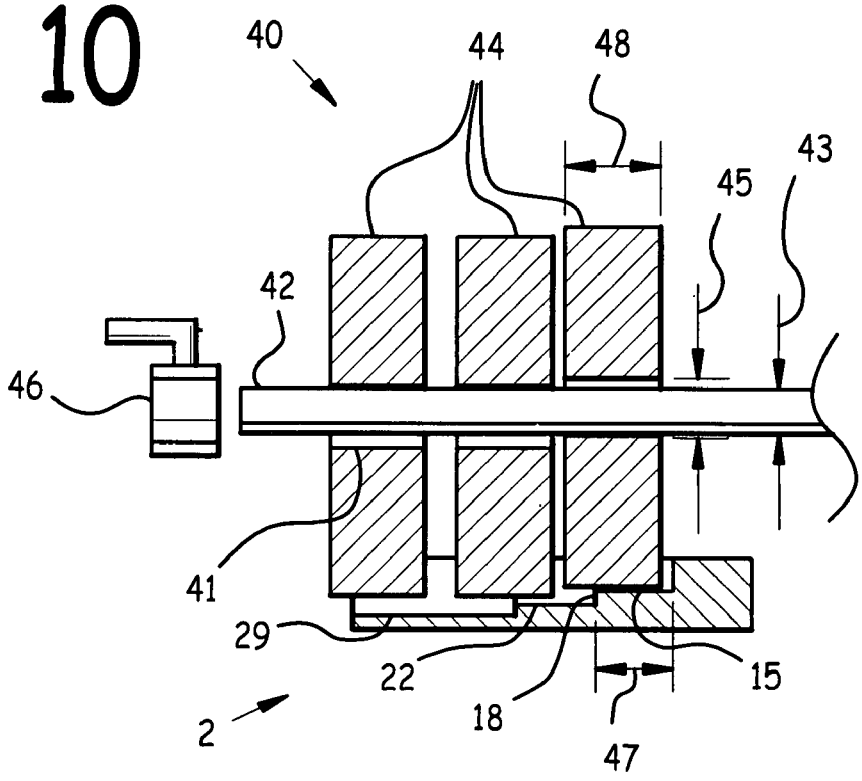
FIG. 10 is a rear cross-sectional view of a barbell having a plurality of weights resting on a stand taken at section IX-IX of FIG. 8.
Figure 11:
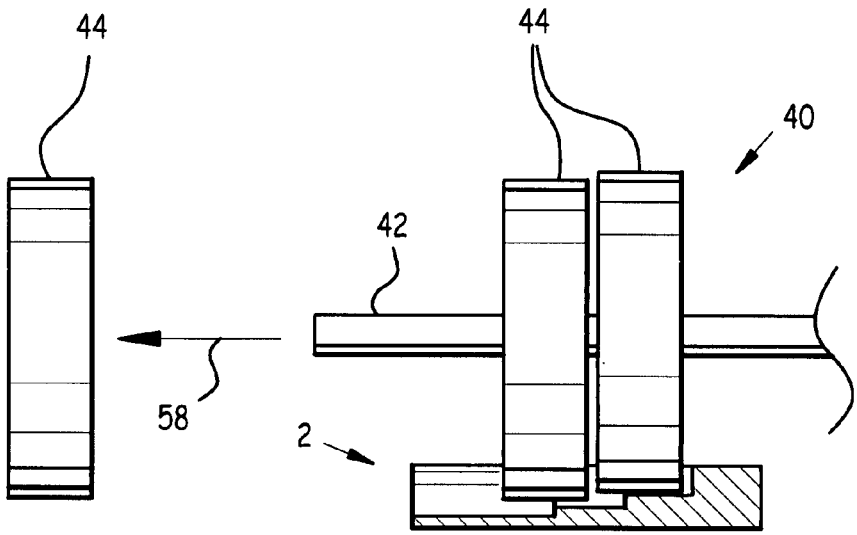
FIGS. 11 and 12 depict the instant method of removing and adding weights to a barbell, once the barbell has been rolled onto at least one stand.
Figure 12:
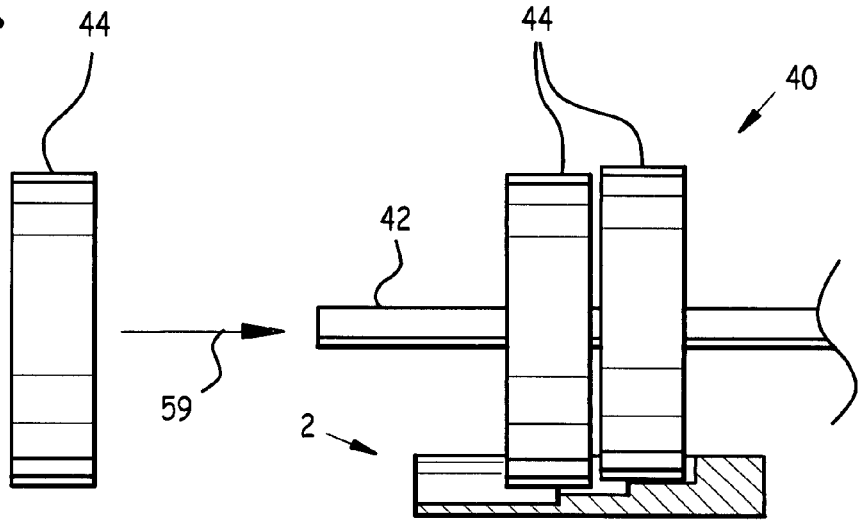

FIGS. 9 and 10 are rear cross-sectional views of a barbell 40 having a plurality of weights 44 resting on stand 2 taken at section IX-IX of FIG. 8. FIGS. 11 and 12 depict the instant method of removing and adding weights 44 to a barbell 40 bar 42, once the barbell 40 has been rolled onto at least one stand 2.

As may be observed in FIGS. 9-12, because the height of first cradle floor 15 exceeds the height of second cradle floor 22 by the height of first cradle wall 18, barbell 40 rests only on the innermost weight 44; all other weights other than the innermost weight 44 depend from bar 42 and may be therefore be easily slid onto and off of bar 42 as indicated by arrows 58 and 59 in FIGS. 11 and 12, without frictional interference with second cradle floor 22, or third cradle floor 29.

As may be especially noted in FIG. 10, each weight 44 has a weight bore 41 through which bar 42 slides. This permits weights 44 to slide onto and off of bar 42. The weight bore diameter 45 of weight bore 41 must exceed the bar diameter 43 of bar 42 to permit weights 44 to slide onto and off of bar 42 without friction. Therefore, all weights 44 other than the innermost weight 44 (which is supported by first cradle 12) hang lower than the innermost weight 44 by a distance equal to the difference between weight bore diameter 45 and bar diameter 43. This is because bar 42 rests on the lowest part of the weight bore 41 of the innermost weight 44 (which is supported by first cradle 12), while the weights 44 other than the innermost weight 44 hang from bar 42 by the uppermost part of their corresponding weight bores 41. For this reason, it follows that the height of first cradle wall 18 must equal or exceed the difference between weight bore diameter 45 and bar diameter 43 in order to avoid interference between weights 44 being added or removed, and second cradle floor 22.

For the same reason it also follows that first cradle width 47 must be less than the weight width 48 of the innermost weight 44, to prevent part of the second-innermost weight 44 from also resting on first cradle 12. If part of the second-innermost weight 44 were also resting in first cradle 12, it would be harder to slide the second-innermost weight 44 onto and off of bar 42 due to friction between the second-innermost weight 44 and first cradle floor 15. Therefore, in the preferred embodiment, the height of first cradle wall 18 equaled or exceeded the difference between weight bore diameter 45 and bar diameter 43, and first cradle width 47 was less than the weight width 48 of the innermost weight 44.

Figure 13:
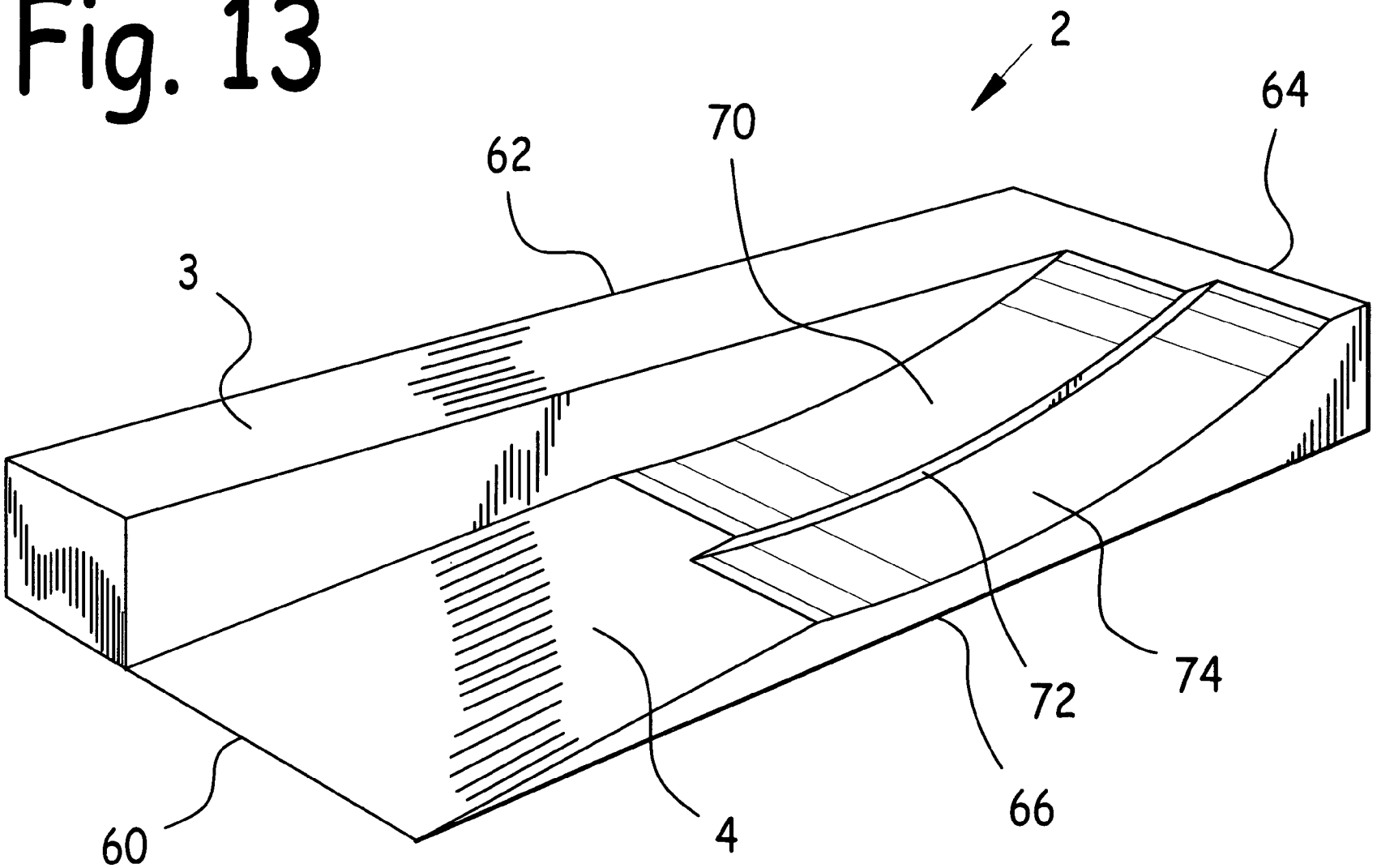
FIG. 13 is a right quarter side elevated isometric view of an alternate embodiment stand incorporating a first cradle and a second cradle, and uses an alternative nomenclature.

Thus, as illustrated in FIGS. 11 and 12, weights 44 may be slid off of bar 42 as indicated by arrow 58 in FIG. 11, or onto bar 42 as indicated by arrow 59 in FIG. 12, without having to lift bar 42 manually. From the above discussion, it may be noted that third cradle 26 is not necessary to the weight-removal and weight-addition function of the instant stand 2. Therefore, it is intended to fall within the scope of this disclosure that stand 2 may comprise only first cradle 12 and second cradle 19 at the top of ramp 4, as depicted in FIG. 13. Similarly, although the preferred embodiment included railing 3, railing 3 is not essential to the function of stand 2, and it is intended to fall within the scope of this disclosure that an alternate embodiment stand 2 may omit railing 3.

Referring now to FIG. 9, barbell 40 may comprise collar 46 which must be removed prior to adding or removing weights 44. After weights 44 are removed from and/or added to bar 42, collar 46 may be replaced to prevent weights 44 from sliding of the end of bar 42. Most barbells also incorporate a collar or stop on the opposite side of weights 44 from collar 46 (not shown in the instant figures) to prevent weights 44 from sliding inwards.

The cross-sectional shape of cradles 12, 19 and 26 may be any appropriate shape incorporating a cradle proximal lip 13, 20 or 27 adjacent ramp 4, and cradle distal lip 14, 21 or 28 along an edge of the cradle opposite such cradle's proximal lip. It is desirable that cradle floors 15, 22 and 29 slope upwards gently to their respective cradle proximal lip 13, 20 or 27, respectively, so that little force is required to roll barbell 44 up from first cradle floor 15, over first cradle proximal lip 13, and thence down ramp 4 and off of stand 2. Cradle distal lips 14, 21 and 28 may be any appropriate shape serving to prevent barbell 40 from rolling forward off of first cradle 12, including a dam similar to railing 3 disposed along an edge of first cradle 12 opposite ramp 4.

The cross-sectional shape of first cradle 12 could approximate a circle of radius greater than the radius of the innermost weight 44. With this first cradle 12 cross-sectional shape, the innermost weight 44 will roll, as urged by gravity, to the lowest area of first cradle floor 15, much like a marble inside a wine glass will roll to the lowest point on the interior of that wine glass. Because the radius of curvature of first cradle 12's cross-sectional shape is greater than the radius of curvature of the innermost weight 44, the innermost weight 44 touches first cradle floor 15 at only its point of tangency with the innermost weight 44's circumference, and weights 44 other than innermost weight 44 may be easily removed from or added to bar 42 without interference from second cradle floor 22, first cradle proximal lip 13, or first cradle distal lip 14.

Referring now to FIG. 13, another way to describe the instant stand 2 is as a ramp 4 bordered by railing 3, with at least two mutually adjacent grooves in the upper part of ramp 4. First groove 70 is first cradle 12, and second groove 74 is second cradle 19. Optionally, a third groove (not shown in FIG. 13), which is third cradle 26, may also be disposed in the upper part of ramp 4, but the third groove is not necessary to the function of stand 2.

Stand 2 comprises first side 60 opposite third side 64, and second side 62 opposite fourth side 66. Ramp 4 ascends from first side 60 to first groove 70 and second groove 74. First groove 70 extends from ramp 4 to third side 64, and second groove 74 adjacent first groove 70 extends from ramp 4 to third side 64. The lowest points of grooves 70 and 74 are disposed between ramp 4 and third side 64. Thus, grooves 70 and 74 slope upwards from their respective lowest areas to third side 64 and ramp 4. Railing 3 may be disposed along second side 62. A cross-sectional shape of first groove 70 is substantially the same as a cross-sectional shape of second groove 74, and first groove 70 is higher than second groove 74 by a height equal to the height of first groove wall 72.

Referring now to FIG. 7, the instant apparatus and method for changing barbell weights may comprise alignment indicia 34 on the surface upon which stand(s) 2 rest and upon which barbell 40 rolls. Alignment indicia 34 aid lining up barbell 40 to roll up stand(s) 2 parallel to ramp inner edge 10 and first cradle inner edge 16, with the innermost weight(s) 44 adjacent first cradle inner edge(s) 16. In the preferred embodiment, alignment indicia 34 were strips disposed on the surface upon which stands 2 rest, on lines containing ramp inner edge 10 and ramp outer edge 11 when viewed in plan view. Rolling a stack of weights 44 between these strips would correctly place barbell 40 to roll up ramp(s) 4 and into first cradle(s) 12.

The instant apparatus and method for changing barbell weights may comprise mat 76 to which stand(s) 2 are attached, whereby stand(s) 2 may be fixed in the correct position to roll a barbell onto, and to prevent stand(s) 2 from sliding out of position.

Thus, the instant method comprises the steps of:

A. Rolling a barbell 40 up ramp 4 and into first cradle 12, such that an innermost weight 44 of barbell 40 is disposed on first cradle floor 15;

B. Removing or adding weights 44 from bar 42 as desired;

C. Rolling barbell 40 out of first cradle 12, down ramp 4, and off of stand 2.

The instant method may comprise the further steps of using alignment indicia 34 and/or railing 3 to facilitate rolling barbell 40 up ramp 4 and into first cradle 12 such that an innermost weight 44 of barbell 40 is disposed on first cradle floor 15, removing collar 46 from bar 42 prior to changing weights 44, and replacing collar 46 after changing weights 44.

In the preferred embodiment, stand 2 was made of plastic, nylon, rubber, synthetic, metal, wood, or other appropriate material. Alignment indicia 34 were strips of colorful or clearly visible material, and could incorporate reflective, metallic, holographic, or other appropriate finish. Barbell 40 was a commercially available, standard barbell. Mat 76 was foam rubber, synthetic, or other impact-absorbent material.

While a preferred embodiment of the invention has been illustrated herein, it is to be understood that changes and variations may be made by those skilled in the art without departing from the spirit of the appending claims.

DRAWING ITEM INDEX

2 stand
3 railing
4 ramp
6 ramp proximal edge
7 ramp first distal edge
8 ramp second distal edge
9 ramp third distal edge
10 ramp inner edge
11 ramp outer edge
12 first cradle
13 first cradle proximal lip
14 first cradle distal lip
15 first cradle floor
16 first cradle inner edge
17 first cradle outer edge
18 first cradle wall
19 second cradle
20 second cradle proximal lip
21 second cradle distal lip
22 second cradle floor
23 second cradle inner edge
24 second cradle outer edge
25 second cradle wall
26 third cradle
27 third cradle proximal lip
28 third cradle distal lip
29 third cradle floor
30 third cradle inner edge
31 third cradle outer edge
34 alignment indicia
40 barbell
41 weight bore
42 bar
43 bar diameter
44 weight
45 weight bore diameter
46 collar
47 first cradle width
48 weight width
50 arrow
52 arrow
54 arrow
56 arrow
59 arrow
60 first side
62 second side
64 third side
66 fourth side
70 first groove
72 first groove wall
74 second groove
76 mat

I claim:

1. An apparatus for changing barbell weights comprising a stand, said stand comprising:

a ramp sloping up to a first cradle and a second cradle;

said first cradle comprising a first cradle floor bordered by a first cradle proximal lip adjacent said ramp, a first cradle distal lip disposed along an edge of said first cradle opposite said ramp, and a first cradle outer edge extending from said first cradle proximal lip to said first cradle distal lip, a height of said first cradle proximal lip and a height of said first cradle distal lip exceeding a height of said first cradle floor;

said second cradle comprising a second cradle floor bordered by a second cradle proximal lip adjacent said ramp, a second cradle distal lip disposed along an edge of said second cradle opposite said ramp, and a second cradle inner edge extending from said second cradle proximal lip to said second cradle distal lip, said first cradle outer edge being disposed directly adjacent said second cradle inner edge, a height of said second cradle proximal lip and a height of said second cradle distal lip exceeding a height of said second cradle floor; and a height of said first cradle exceeding a height of said second cradle by a height of a first cradle wall ascending from said second cradle inner edge to said first cradle outer edge.

2. The apparatus for changing barbell weights of claim 1 wherein a cross-sectional shape of said first cradle is substantially the same as a cross-sectional shape of said second cradle.

3. The apparatus for changing barbell weights of claim 2 further comprising a railing along an edge of said stand opposite said second cradle.

4. The apparatus for changing barbell weights of claim 3 wherein said first cradle floor slopes gently up to said first cradle proximal lip, and said first cradle floor slopes gently up to said first cradle distal lip.

5. The apparatus for changing barbell weights of claim 4 further comprising a third cradle along an edge of said second cradle opposite said first cradle, said third cradle comprising a third cradle floor bordered by a third cradle proximal lip adjacent said ramp and a third cradle distal lip disposed along an edge of said third cradle opposite said ramp, a cross-sectional shape of said third cradle being substantially the same as a cross-sectional shape of said second cradle, a height of said second cradle exceeding a height of said third cradle by a height of a second cradle wall between said second cradle and said third cradle.

6. In combination, the apparatus for changing barbell weights of claim 1 and a barbell, said barbell comprising at least one weight and a bar slid through a weight bore in said weight, a width of said weight exceeding a width of said first cradle.

7. The apparatus for changing barbell weights of claim 6 wherein a height of said first cradle wall exceeds a difference between a diameter of said weight bore and a diameter of said bar.

8. The apparatus for changing barbell weights of claim 6 wherein a cross-sectional shape of said first cradle is substantially an arc of a circle of radius greater than a radius a cross-sectional shape of said weight.

9. The apparatus for changing barbell weights of claim 8 further comprising a mat to which at least one said stand is attached, whereby said stand may be fixed in a correct position onto which to roll a dumbbell, and whereby said stand may be prevented from sliding out of position.

10. A method for changing barbell weights using an apparatus for changing barbell weights comprising the steps of:

A. Providing a stand, said stand comprising:

a ramp sloping up to a first cradle and a second cradle;

said first cradle comprising a first cradle floor bordered by a first cradle proximal lip adjacent said ramp and a first cradle distal lip disposed along an edge of said first cradle opposite said ramp, a height of said first cradle proximal lip and first cradle distal lip exceeding a height of said first cradle floor;

said second cradle comprising a second cradle floor bordered by a second cradle proximal lip adjacent said ramp and a second cradle distal lip disposed along an edge of said second cradle opposite said ramp, a height of said second cradle proximal lip and second cradle distal lip exceeding a height of said second cradle floor; and a height of said first cradle exceeding a height of said second cradle by a height of a first cradle wall between said first cradle and said second cradle;

B. Providing a barbell comprising at least one circular weight;

C. Rolling at least one said circular weight up said ramp and into said first cradle, whereby an innermost said weight is disposed on said first cradle floor;

D. Removing at least one said weight from said barbell; and

E. Rolling said barbell out of said first cradle, down said ramp, and off of said stand.

11. The method for changing barbell weights of claim 10 wherein said apparatus for changing barbell weights further comprises a railing along an edge of said stand opposite said second cradle, and said method comprises the further step of rolling said at least one weight up said ramp adjacent said railing, and into said first cradle adjacent said railing, and said method comprises the further step of using said railing as a guide to roll said barbell into said cradle.

12. The method for changing barbell weights of claim 11 wherein said apparatus to change barbell weights further comprises alignment indicia on a surface upon which said stand rests, and said method comprises the further step of aligning said barbell with said alignment indicia to properly align said barbell to roll up said ramp and into said cradle.

13. The method for changing barbell weights of claim 12 wherein said alignment indicia comprise strips on said surface disposed on lines containing a ramp inner edge and an opposite ramp outer edge when viewed in plan view.

14. In combination, an apparatus for changing barbell weights and a barbell; said apparatus for changing barbell weights comprising a stand, said stand comprising a first side opposite a third side, and a second side opposite a fourth side, a ramp ascending from said first side to a first groove and a second groove, said first groove extending from said ramp to said third side, said second groove being disposed adjacent said first groove and extending from said ramp to said third side, lowest areas of said first groove and said second groove being disposed between said ramp and said third side, said first groove being higher than said second groove by a height equal to a height of a first groove wall disposed between said first groove and said second groove; said barbell comprising at least one weight and a bar slid through a weight bore in said weight, a width of said weight exceeding a width of said first groove.

15. The apparatus for changing barbell weights of claim 14 wherein a height of said first groove wall exceeds a difference between a diameter of said weight bore and a diameter of said bar.

16. The apparatus for changing barbell weights of claim 14 wherein a cross-sectional shape of said first groove is substantially the same as a cross-sectional shape of said second groove.

17. The apparatus for changing barbell weights of claim 14 further comprising a railing disposed along said second side.

18. An apparatus for changing barbell weights comprising a pair of stands, one said stand being a mirror image of the other said stand, each said stand comprising:

a ramp sloping up to a first cradle and a second cradle, said first cradle being adjacent said second cradle;

said first cradle comprising a first cradle floor bordered by a first cradle proximal lip adjacent said ramp, a first cradle distal lip disposed along an edge of said first cradle opposite said ramp, and a first cradle outer edge extending from said first cradle proximal lip to said first cradle distal lip, a height of said first cradle proximal lip and a height of said first cradle distal lip exceeding a height of said first cradle floor;

said second cradle comprising a second cradle floor bordered by a second cradle proximal lip adjacent said ramp, a second cradle distal lip disposed along an edge of said second cradle opposite said ramp, and a second cradle inner edge extending from said second cradle proximal lip to said second cradle distal lip, said first cradle outer edge behind disposed directly adjacent said second cradle inner edge, a height of said second cradle proximal lip and a height of said second cradle distal lip exceeding a height of said second cradle floor; and a height of said first cradle exceeding a height of said second cradle by a height of first cradle wall between said first cradle and said second cradle.

19. In combination, the apparatus for changing barbell weights of claim 18 and a barbell, said barbell comprising at least one weight and a bar slid through a weight bore in said weight, a width of said weight exceeding a width of said first cradle, said stands being spaced apart a distance substantially equal to a distance between weight stacks on said barbell.

20. The apparatus for changing barbell weights of claim 19 wherein a height of said first cradle wall exceeds a difference between a diameter of said weight bore and a diameter of said bar.

21. The apparatus for changing barbell weights of claim 20 wherein a cross-sectional shape of said first cradle is substantially an arc of a circle of radius greater than a radius a cross-sectional shape of said weight.

22. A method for changing barbell weights using an apparatus for changing barbell weights comprising the steps of:

A. Providing a pair of stands, said stands being spaced apart a distance substantially equal to a distance between circular weights at each end of a barbell, each said stand comprising a first side opposite a third side, and a second side opposite a fourth side, a ramp ascending from said first side to a first groove and a second groove, said first groove extending from said ramp to said third side, said second groove being disposed adjacent said first groove and extending from said ramp to said third side, lowest areas of said first groove and said second groove being disposed between said ramp and said third side, said first groove being higher than said second groove by a height equal to a height of a first groove wall disposed between said first groove and said second groove;

B. Providing a barbell comprising at least one circular weight;

C. Rolling at least one said barbell weight up each said ramp and into respective said first grooves, whereby an innermost said weight is disposed on each said first groove;

D. Removing at least one said weight from said barbell; and

E. Rolling said barbell out of said first grooves, down said ramp, and off of said stands.

23. The method for changing barbell weights of claim 22 wherein said apparatus for changing barbell weights further comprises a railing along an edge of each said stand opposite said second groove, and said method comprises the further step of rolling said at least one weight up said ramps adjacent said railings, and into said first grooves adjacent said railings, whereby said railings act as guides to roll said barbell into said first grooves.

24. The method for changing barbell weights of claim 23 wherein said apparatus to change barbell weights further comprises alignment indicia on a surface upon which said stands rest, and said method comprises the further step of aligning said barbell with said indicia in order to properly position said barbell to roll up said ramp and into said cradle.

25. The method for changing barbell weights of claim 24 wherein said alignment indicia comprise strips on said surface disposed on lines containing ramp inner edges and corresponding opposite ramp outer edges when viewed in plan view, and said method comprises the further step of aligning said barbell with said indicia in order to properly position said barbell to roll up said ramp and into said cradle.

26. The apparatus for changing barbell weights of claim 1 wherein said first cradle is bordered by a first cradle outer edge adjacent said second cradle, said second cradle is bordered by a second cradle inner edge adjacent said first cradle, and said first cradle wall extends vertically upwards from said second cradle inner wall to said first cradle outer wall.

27. A method for changing barbell weights using an apparatus for changing barbell weights comprising the steps of:

A. Providing a stand, said stand comprising:

a ramp sloping up to a first cradle and a second cradle;

said first cradle comprising a first cradle floor bordered by a first cradle proximal lip adjacent said ramp and a first cradle distal lip disposed along an edge of said first cradle opposite said ramp, a height of said first cradle proximal lip and first cradle distal lip exceeding a height of said first cradle floor;

said second cradle comprising a second cradle floor bordered by a second cradle proximal lip adjacent said ramp and a second cradle distal lip disposed along an edge of said second cradle opposite said ramp, a height of said second cradle proximal lip and second cradle distal lip exceeding a height of said second cradle floor; and a height of said first cradle exceeding a height of said second cradle by a height of a first cradle wall between said first cradle and said second cradle;

B. Providing a barbell comprising at least one circular weight;

C. Rolling at least one said weight up said ramp and into said first cradle, whereby an innermost said weight is disposed on said first cradle floor;

D. Providing at least one additional weight;

E. Adding at least one said additional weight to said barbell; and

F. Rolling said barbell out of said first cradle, down said ramp, and off of said stand.

28. A method for changing barbell weights using an apparatus for changing barbell weights comprising the steps of:

A. Providing a pair of stands, said stands being spaced apart a distance substantially equal to a distance between circular weights at each end of a barbell, each said stand comprising a first side opposite a third side, and a second side opposite a fourth side, a ramp ascending from said first side to a first groove and a second groove, said first groove extending from said ramp to said third side, said second groove being disposed adjacent said first groove and extending from said ramp to said third side, lowest areas of said first groove and said second groove being disposed between said ramp and said third side, said first groove being higher than said second groove by a height equal to a height of a first groove wall disposed between said first groove and said second groove;

B. Providing a barbell comprising at least one circular weight;

C. Rolling at least one said barbell weight up each said ramp and into respective said first grooves, whereby an innermost said weight is disposed on each said first groove;

D. Providing at least one additional weight;

E. Adding at least one said additional weight to said barbell; and

F. Rolling said barbell out of said first cradle, down said ramp, and off of said stands.

* * * * *